US010928041B2

(12) United States Patent
Zou et al.

(10) Patent No.: US 10,928,041 B2
(45) Date of Patent: Feb. 23, 2021

(54) LED LAMP, AND LENS MODULE THEREOF

(71) Applicant: OPPLE LIGHTING CO., LTD., Shanghai (CN)

(72) Inventors: Donghong Zou, Shanghai (CN); Guolong Nl, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/834,526

(22) Filed: Mar. 30, 2020

(65) Prior Publication Data

US 2020/0224858 A1 Jul. 16, 2020

Related U.S. Application Data

(63) Continuation of application No. PCT/CN2018/107377, filed on Sep. 25, 2018.

(30) Foreign Application Priority Data

Sep. 29, 2017 (CN) ..... 201721286883.2

(51) Int. Cl.

| | |
|---|---|
| ***F21V 17/16*** | (2006.01) |
| ***F21V 17/14*** | (2006.01) |
| ***F21V 5/04*** | (2006.01) |
| ***F21V 17/18*** | (2006.01) |
| *F21Y 115/10* | (2016.01) |
| *F21Y 115/15* | (2016.01) |

(52) U.S. Cl.

CPC ..... *F21V 17/164* (2013.01); *F21V 5/04* (2013.01); *F21V 17/14* (2013.01); *F21V 17/16* (2013.01); *F21V 17/18* (2013.01); *F21Y 2115/10* (2016.08); *F21Y 2115/15* (2016.08)

(58) Field of Classification Search

CPC .... F21V 15/0015; F21V 17/16; F21V 17/164; F21V 17/18

See application file for complete search history.

(56) References Cited

U.S. PATENT DOCUMENTS 6,382,818 B1 * 5/2002 Iwama ..... F21V 17/164 362/374
8,668,374 B2 * 3/2014 Yoo ..... F21K 9/60 362/651

(Continued)

FOREIGN PATENT DOCUMENTS

CN 104094046 A 10/2014
CN 205261452 U 5/2016

(Continued)

OTHER PUBLICATIONS

International Search Report (including English translation) and Written Opinion issued in PCT/CN2018/107377, dated Dec. 27, 2018, 12 pages.

*Primary Examiner* — Andrew J Coughlin
*Assistant Examiner* — Keith G. Delahoussaye
(74) *Attorney, Agent, or Firm* — Arch & Lake LLP

(57) ABSTRACT

An LED lamp and a lens module are disclosed by the present disclosure. The lens module includes a chassis provided with a mounting slot and a lens body fixed in the mounting slot through a clamping lug and a clamping slot; after moving the lens body along the mounting slot, the clamping lug is clamped in the clamping slot.

11 Claims, 5 Drawing Sheets

(56) References Cited

U.S. PATENT DOCUMENTS

| | | | | |
|---|---|---|---|---|
| 2007/0165415 | A1* | 7/2007 | Henrici | F21V 3/00 362/457 |
| 2018/0216801 | A1* | 8/2018 | Thiele | F21V 19/004 |
| 2019/0264891 | A1* | 8/2019 | Wang | F21V 5/046 |

FOREIGN PATENT DOCUMENTS

| | | | |
|---|---|---|---|
| CN | 106369550 | A | 2/2017 |
| CN | 106704904 | A | 5/2017 |
| CN | 107965682 | A | 4/2018 |
| CN | 107975685 | A | 5/2018 |
| CN | 207455295 | U | 6/2018 |

* cited by examiner

LED LAMP, AND LENS MODULE THEREOF

CROSS-REFERENCE TO RELATED APPLICATIONS

This application is based upon and claims the priority of PCT patent application No. PCT/CN2018/107377 filed on Sep. 25, 2018 which claims the priority of Chinese Patent Application No. 201721286883.2 filed on Sep. 29, 2017, the entire content of all of which is hereby incorporated by reference herein for all purposes.

TECHNICAL FIELD

The present disclosure relates to the technical field of LED lamps, in particular to a lens module of an LED lamp provided with a clamping lug and a clamping slot, and an LED lamp.

BACKGROUND

With the continuous development of the light-emitting diode (LED) technology, LED lamps with the advantages of low power consumption and long service life have appeared.

SUMMARY

Examples of the present disclosure provide a lens module of an LED lamp, an LED lamp, and a method of manufacturing a lens module of an LED lamp.

According to one aspect, a lens module of an LED lamp is provided. The lens module may include a chassis provided with a mounting slot, and a lens body fixed in the mounting slot through a clamping lug and a clamping slot, where, after moving the lens body along the mounting slot, the clamping lug is clamped in the clamping slot.

According to another aspect, An LED lamp is provided. The LED lamp may include a lens module provided with a chassis and a lens body, and an LED light source provided on the lens body, where the chassis is provided with a mounting slot and the lens body is fixed in the mounting slot through a clamping lug and a clamping slot, and where, after moving the lens body along the mounting slot, the clamping lug is clamped in the clamping slot.

According to a further aspect, a method of manufacturing a lens module of an LED lamp is provided. The method may include providing a chassis with a mounting slot; fixing a lens body in the mounting slot through a clamping lug and a clamping slot; and clamping the clamping lug in the clamping slot after moving the lens body along the mounting slot.

It is to be understood that both the foregoing general description and the following detailed description are exemplary and explanatory only and are not restrictive of the present disclosure.

BRIEF DESCRIPTION OF THE DRAWINGS

The accompanying drawings described herein are used to provide a further understanding of the present disclosure, and to form a part of the present disclosure. Illustrative examples of the present disclosure and the description thereof are used to explain the present disclosure, and do not constitute improper limitation of the present disclosure. In the accompanying drawings.

DETAILED DESCRIPTION

Figure 1:
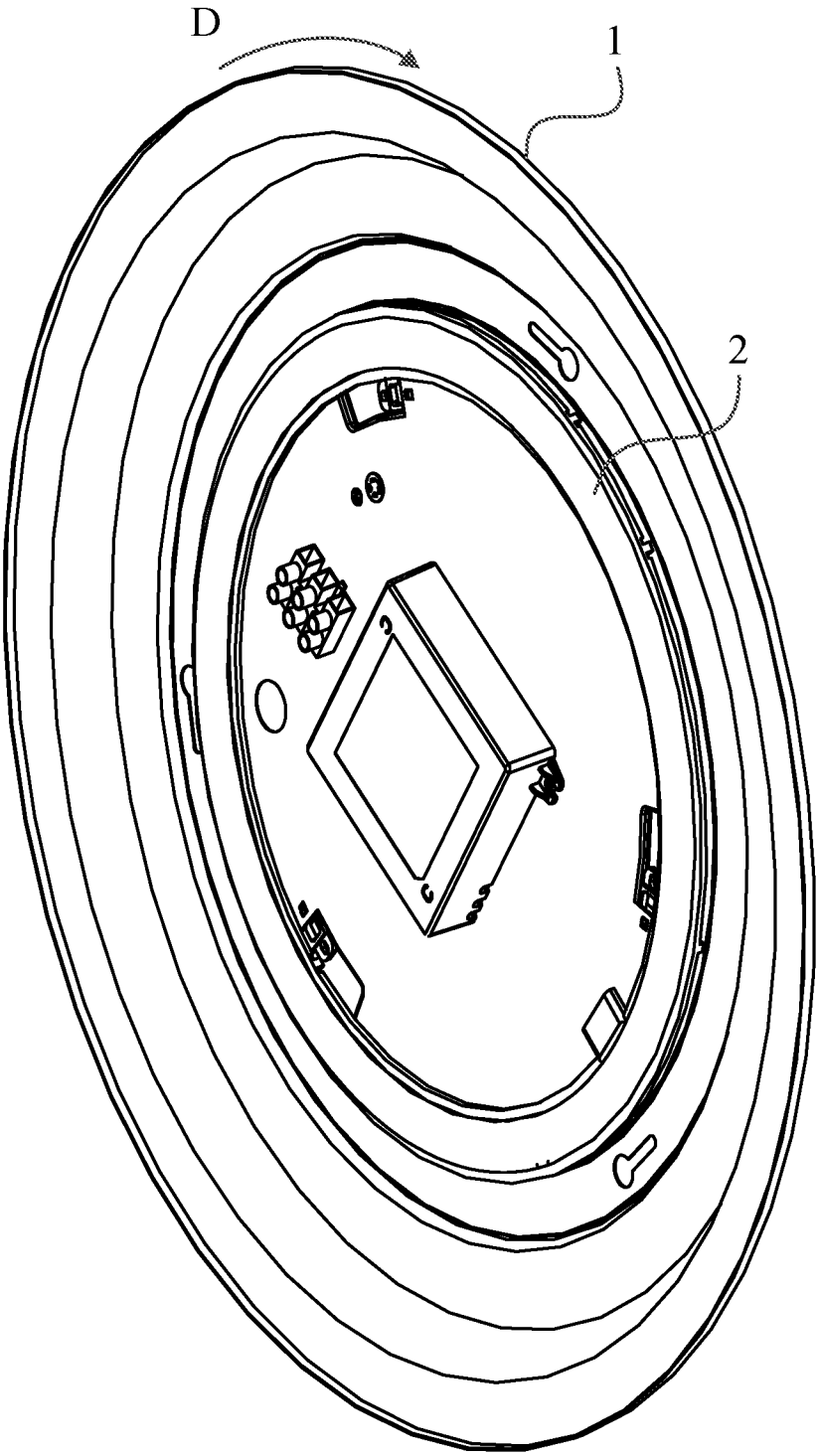
FIG. 1 is a schematic structural diagram of a lens module provided by an example of the present disclosure.

In order to make the object, technical schemes and advantages of the present disclosure clearer, the following descriptions describe the technical schemes of the present disclosure with reference to examples of the present disclosure and corresponding accompanying drawings. The described examples are only some examples of the present disclosure, not all examples. Based on the examples in the present disclosure, all other examples obtained by those of ordinary skill in the art without creative efforts shall fall within the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

In FIG. 1-FIG. 6, the numbers may refer to the following terms: Chassis—1; Lens body—2; Clamping lug—3; Mounting slot—11; Clamping slot—4; Guide part—31; Stopper part—32; First clamping slot part—41; Second clamping slot part—42; Guide part body—311; Receiving hole—312; Screw hole—313; Protrusion—321; Stopper part body—322; Front side wall—411; Insertion opening—412; Screw hole—413; Rotation direction—D.

First of all, it should be noted that a front end in the present disclosure refers to an end in the front along a moving direction D. A rear end in the present disclosure refers to an end in the rear along the moving direction D.

There are many kinds of LED lamps, and a common LED lamp may include an LED light source and a lens module for mounting the LED light source. The LED clamp may include a chassis for mounting on a roof or the like, and may include a lens body that is configured for connection with the chassis and mounting an LED light source. Illumination may be carried out by the LED light source, and the LED light source may be protected by the lens body. Sometimes, the lens body is connected with the chassis through screws. When the lens body is mounted on the chassis, screws need to be screwed in sequence, which is time-consuming and labor-consuming.

Figure 2:
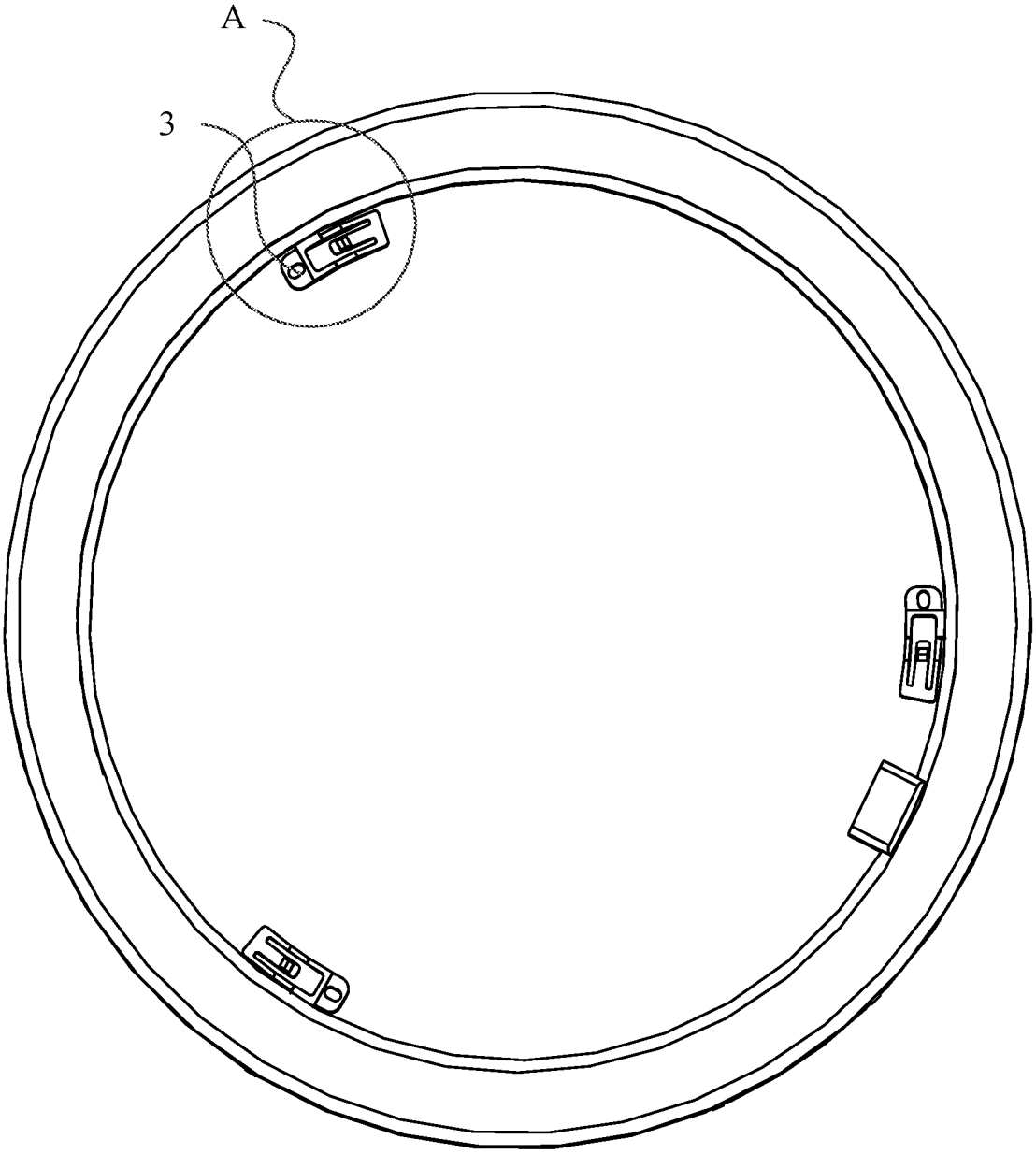
FIG. 2 is a schematic structural diagram of a lens body provided by an example of the present disclosure.
Figure 3:
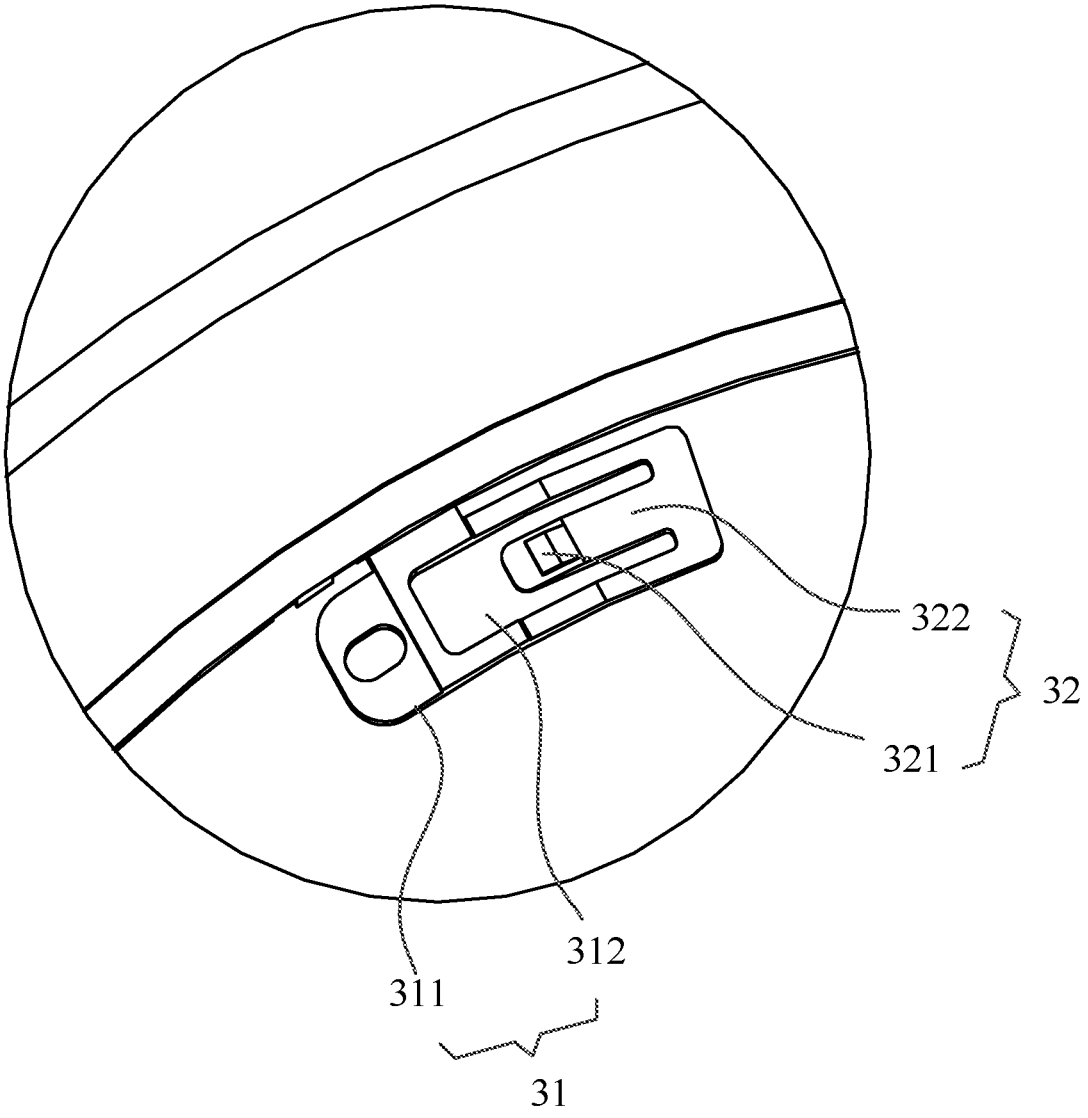
FIG. 3 is an enlarged view of the part A in FIG. 2.
Figure 4:
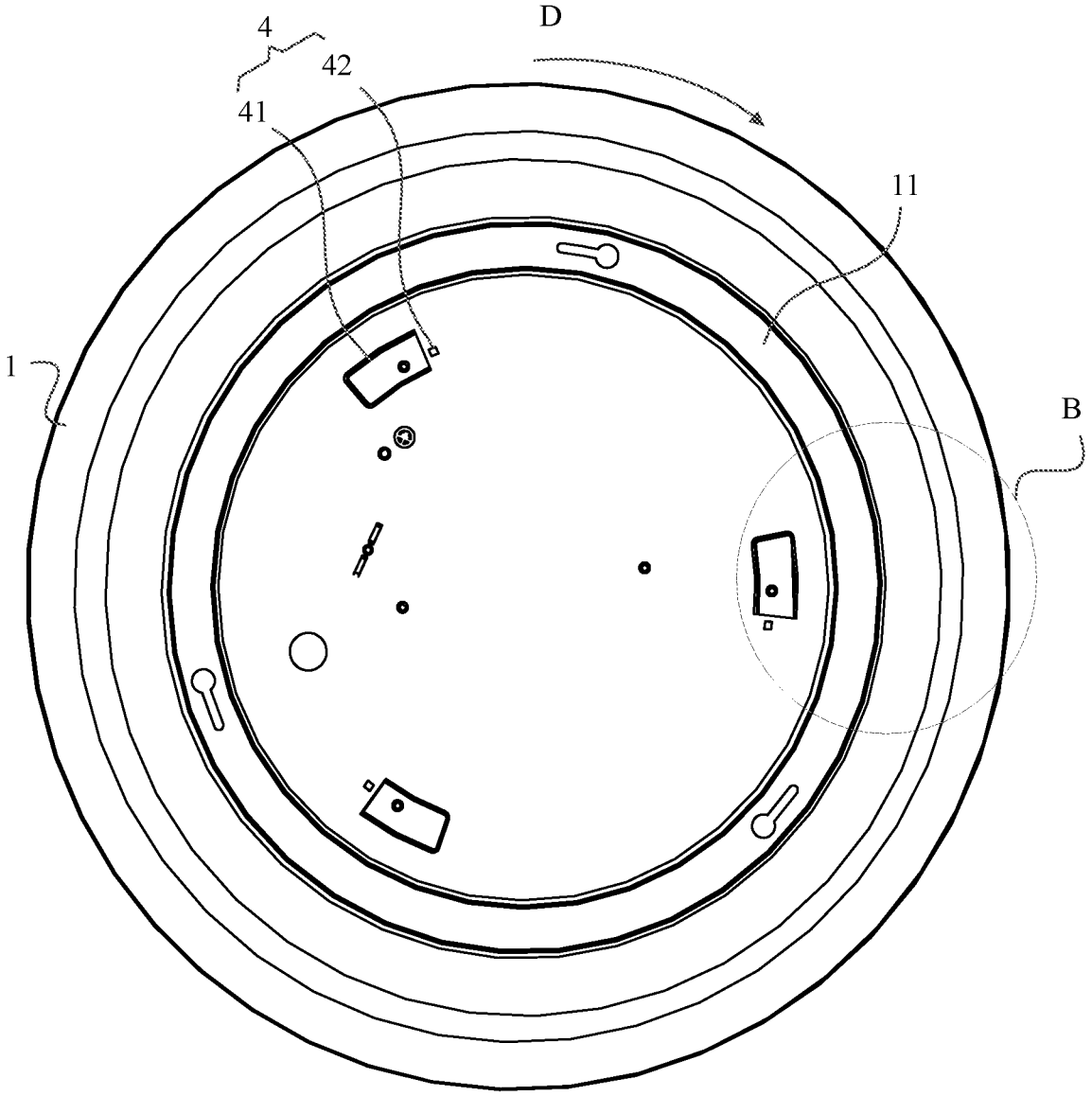
FIG. 4 is a schematic structural diagram of a chassis provided by an example of the present disclosure.

As shown in FIG. 1, the lens module of the LED lamp of the present disclosure includes a chassis 1 provided with a mounting slot 11 (as shown in FIG. 4), and includes a lens body 2 fixed in the mounting slot 11. As shown in FIG. 2-FIG. 4, the lens body 2 is fixed in the mounting slot 11 with a clamping lug 3 and a clamping slot 4. When the lens body 2 needs to be fixed, the lens body 2 is moved along the mounting slot 11 until the clamping lug 3 is clamped in the clamping slot 4. In this way, during fixing the lens body 2, time and labor are saved, and the mounting efficiency is improved.

The lens body 2 and the chassis 1 may be provided in various configurations. In one example, the lens body 2 has a substantially annular shape. The mounting slot 11 may be a slot body recessed toward an inside of the chassis 1, and in this case, the mounting slot 11 may also have an annular shape that is adapted to the annular shape of the lens body 2. When the clamping lug 3 is clamped, the lens body 2 is rotated around the mounting slot 11, so that the clamping lug 3 is clamped in the clamping slot 4. In this way, it is convenient to machine the mounting slot 11 and the lens body 2, and to rotate the lens body 2 around the mounting slot 11.

The shape of the chassis 1 may also be a circular shape that is adapted to the shape of the lens body 2, thus improving the artistic appearance and practicability of the LED lamp. The size of the lens body 2 and the material of the lens body 2 as well as the size of the chassis 1 and the material of the chassis 1 can be specifically set according to requirements, and will not be described in detail here.

In another example (not shown in the figure), the lens body 2 has a substantially straight bar shape. The mounting slot 11 may also have a straight bar shape that is adapted to the straight bar shape of the lens body 2. When the clamping lug 3 is clamped, the lens body 2 is moved along the mounting slot 11, so that the clamping lug 3 is clamped in the clamping slot 4. In this case, the chassis 1 may have a rectangular shape.

In an example, the lens body 2 and the mounting slot 11 of the chassis 1 have annular shapes, and the structure configurations of the clamping slot 3 and the clamping slot 4 are described in detail.

The clamping slot 3 can be provided on the chassis 1, or provided on the lens body 2. As shown in FIG. 2 and FIG. 3, when the clamping slot 3 is provided on the lens body 2, the clamping slot 3 is protruded out of the lens body 2, and the clamping slot 3 can be located at the inside of the lens body 2, or at the outside of the lens body 2, or can be provided in pair at the inside of the lens body 2 and the outside of the lens body 2, simultaneously. In order to facilitate the production and transportation of lenses, the clamping slot 3 is provided at the inside of the lens body, in this example.

The clamping slot 3 can be provided in a variety of ways. In one example, the clamping slot 3 includes a stopper part 32 provided with a protrusion 321 and a guide part 31 serving as a guide. The guide part 31 includes a guide part body 311 and a receiving hole 312, the guide part body 311 is connected with the lens body 2 and configured to be placed in the clamping slot 4, and the receiving hole 312 is provided at a front end of the guide part body 3311 and provided to receive the stopper part 32. The guide body 311 may be an arc-shaped plate, and the arc-shaped plate is concentric with the annular shape of the lens body. In the example of the lens body with the straight bar shape, the guide body 311 is parallel to the lens body. The middle part of the arc-shaped plate is connected with the lens body 2, and a certain gap is left between the side wall of the front end of the arc-shaped plate with the side wall of the lens body 2, and also between the side wall of the rear end of the arc-shaped plate with the side wall of the lens body 2, so that the arc-shaped plate can be conveniently inserted into the clamping slot 4.

The stopper part 32 includes an stopper part body 322, of which the front end is connected with the front wall of the receiving hole 312, and the protrusion 321, which is described above. The protrusion 321 is provided at the rear end of the stopper part body 322. In this way, it is convenient to machine the clamping slot 3, and the stopper part 32 can have a certain deformation capability to facilitate clamping of the protrusion 321 in the clamping slot 4; moreover, when the protrusion 321 is withdrawn from the clamping slot 4, the damage to the clamping lug 3 can be reduced. The stopper part body 322 may be an arc-shaped plate, and has a certain length along the rotation direction D so as to facilitate machining. The front end of the arc-shaped plate is connected with the front wall of the receiving hole 312, and the rear end of the arc-shaped plate is provided with the protrusion 321.

The protrusion 321 is provided separately from the guide part 31. In other words, it means that the protrusion 321 is provided on the stopper part body 322, which is different from the guide part 31. When the protrusion 321 is clamped in or withdrawn from the clamping slot 4, the deformation of the guide part 31 is not substantially caused, but the deformation of the stopper part body 322 is caused.

Of course, the clamping lug can also be provided in other ways. For example, the stopper part is not provided in the receiving hole of the guide part, but is located in front of the guide part, and is connected to the lens body, etc.

Figure 5:
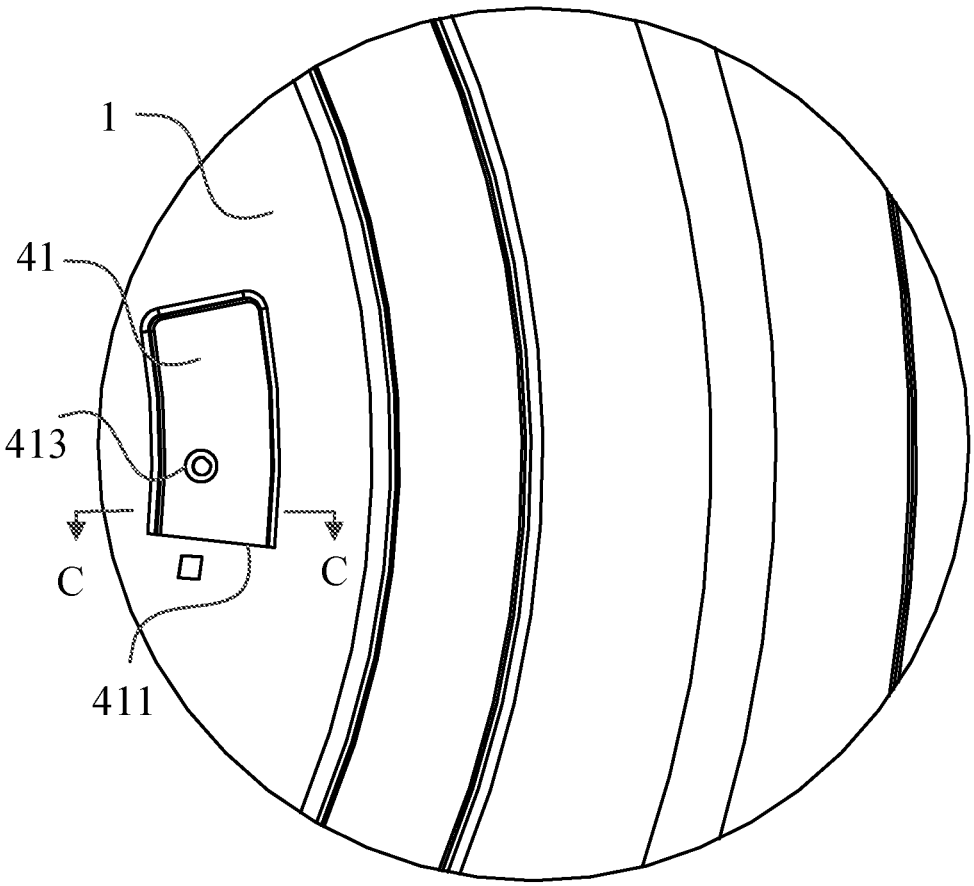
FIG. 5 is an enlarged view of the part B in FIG. 4.
Figure 6:
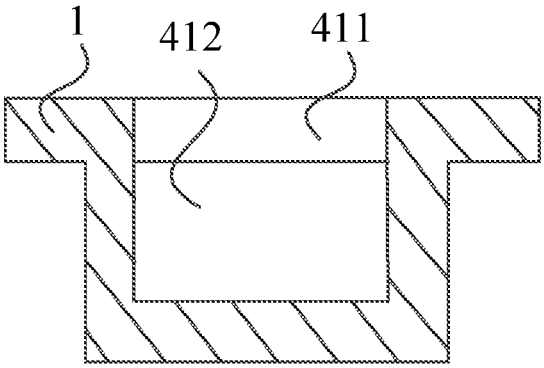
FIG. 6 is a cross-sectional view taken along the line C-C in FIG. 5.

As shown in FIG. 4-FIG. 5, the clamping slot 4 is provided on the bottom wall of the chassis 1, and is located at the inside of the mounting slot 11 to facilitate machining. The clamping slot 4 includes a first clamping slot part 41 for placing the guide body 311, and includes a second clamping slot part 42 located in front of the first clamping slot part 41 and provided with the protrusion 321. The first clamping slot part 41 is recessed toward the chassis 1. The first clamping slot part 41 may be in an arc-shape that has the same shape and size as the shape and size of the guide body 311. The rear end of the second clamping slot part 42 has a straight edge to facilitate clamping with the protrusion 321. The first clamping slot part 41 is spaced from the second clamping slot part 42, and the front side wall 411 of the first clamping slot part 41 is provided with an insertion opening 412 of the guide body 311 (as shown in FIG. 6).

When the clamping lug 3 is clamped, the guide part body 311 is first placed in the first clamping slot part 41, and then the guide part body 311 is rotated clockwise (refer to FIG. 1) around the mounting slot 11. After the guide part body 311 is rotated by a certain angle, the guide part body 311 and the stopper part body 322 pass through the insertion opening 412, and the protrusion 321 of the stopper part 32 is clamped in the second clamping slot part 42.

According to the above described configurations, the structure is simple, the machining is convenient, the cost is low, and the usage is time-saving and labor-saving. The fixation of the lens body 2 and the chassis 1 is realized through the clamping of the protrusion 321 and the second clamping slot part 42, and the protrusion 321 is guided to be clamped in the second clamping slot part 42 through the matching of the guide part 31 and the first clamping slot part 41, so the dislocation of the clamping lug 3 and the clamping slot 4 can be prevented, and the clamping of the protrusion 321 and the second clamping slot part 42 is conveniently realized. Moreover, when the protrusion 321 is withdrawn from the second clamping slot part 42, the obstacle against the protrusion 321 by the guide part 31 can be reduced, thereby reducing the damage of the clamping lug 3. Moreover, the guide part 31 also can have a certain auxiliary supporting function to improve the fixing firmness of the clamping lug 3.

At least three clamping lugs 3 and at least three clamping slots 4 opposite to the clamping lugs may be provided along the circumferential direction of the lens body 2. Herein, Different clamping lugs 3 are clamped in different clamping slots 4 to improve the mounting firmness of the lens body 2.

In addition, a screw hole 313 may be further provided at the rear end of the guide body 311. The clamping slot 4 is provided with a screw hole 413 corresponding to the screw hole 313. The clamping lug 3 and the clamping slot 4 can be further fixed by the screw fixed in the screw hole 313 and the screw hole 413 to further improve the fixing firmness of the lens body 2.

When the lens body 2 and the mounting slot 11 of the chassis 1 are provided with straight bar shapes, the difference of the clamping lug and the clamping slot from those described in the above examples lies in that there are at least two clamping lugs, the clamping lugs can be located at any one of two sides of the lens body, or the clamping lugs can be provided at both sides of the lens body 2, and the clamping lugs provided at two sides of the lens body can be provided in pairs or staggered arrangement. The guide part body and the stopper part body are straight plate-shaped, and the shape of the clamping slot is matched with the shape of the guide part body. At least two lens bodies 2 are provided side by side along a length direction on the chassis 1, and each of the at least two lens bodies 2 is extended along the width direction of the chassis 1.

The LED lamp of the present disclosure includes a lens module and an LED light source, the lens module is provided with a chassis 1 and a lens body 2, and the LED light source is provided on the lens body; the lens module is the above described lens module. In the LED lamp, the lens body 2 is fixed to the chassis 1 through the clamping lug 3 and the clamping slot 4. When the lens body 2 is fixed, after moving the lens body 2 along the mounting slot of the chassis 1, the clamping lug 3 is clamped in the clamping slot 4, thereby realizing the fixation of the lens body 2. Because the clamping lug is clamped in the clamping slot 4 by moving the lens body 2, when a plurality of clamping lugs 3 and a plurality of clamping slots 4 are provided, the plurality of clamping lugs 3 can be simultaneously clamped in the clamping slots 4 respectively by moving the lens body 2. In this way, the plurality of clamping lugs 3 do not need to be respectively clamped in the plurality of clamping slots 4 in sequence, thus saving time and labor. Moreover, the clamping lug 3 can be fixed by moving the clamping lug 3 into the clamping slot 4, which takes less time than screwing bolts, thus further improving the mounting efficiency.

Examples of the present disclosure provide a lens module of an LED lamp, which is used for solving the problem of time-consuming and labor-consuming, during mounting of a lens body on a chassis.

The examples of the present disclosure adopt the following technical schemes.

A lens module of an LED lamp of the present disclosure includes:

a chassis, provided with a mounting slot; and a lens body, fixed in the mounting slot through a clamping lug and a clamping slot, wherein after moving the lens body along the mounting slot, the clamping lug is clamped in the clamping slot.

Optionally, the clamping lug includes: an stopper part provided with a protrusion that is clamped in the clamping slot, and a guide part that is moved in the clamping slot to guide the protrusion, wherein the stopper part is provided separately from the guide part.

Optionally, the guide part and the stopper part are both located at a same side of the lens body, and protruded out of the lens body toward the same side of the lens body.

Optionally, the guide part includes: a guide part body that is connected with the lens body and moved in the clamping slot, and a receiving hole that is provided at a front end of the guide part body, and provided to receive the stopper part.

Optionally, the stopper part includes an stopper part body, of which a front end is connected with a front wall of the receiving hole, wherein the protrusion is provided at a rear end of the stopper part body.

Optionally, the guide part body and the stopper part body are both plate-shaped structures.

Optionally, the guide part body and the stopper part body are both plate-shaped structures. The clamping slot includes: a first clamping slot part that is configured to place the guide part body and recessed, and a second clamping slot part that is located in front of the first clamping slot part and provided with the protrusion, wherein the first clamping slot part is spaced from the second clamping slot part, and a front side wall of the first clamping slot part is provided with an insertion opening, into which the guide part body is inserted.

Optionally, the lens body has an annular shape, the mounting slot is recessed toward an inside of the chassis and has an annular shape that is adapted to the annular shape of the lens body, and the clamping slot is provided on a bottom wall of the chassis; and after rotating the lens body around the mounting slot, the clamping lug is clamped in the clamping slot.

Optionally, at least three clamping lugs, and clamping slots that are matched with each of the at least three clamping lugs are provided along a circumferential direction of the lens body.

The LED lamp of the present disclosure, includes a lens module provided with a chassis and a lens body, and an LED light source provided on the lens body, wherein the lens module is the lens module according to any one of the above described lens module.

The at least one technical scheme adopted by the examples of the present disclosure can achieve the following beneficial effects.

The lens body is fixed with the chassis through a clamping lug and a clamping slot. When the lens body is fixed, after moving the lens body along the mounting slot of the chassis, the clamping lug is clamped in the clamping slot, thereby realizing the fixation of the lens body. Because the clamping lug is clamped in the clamping slot by moving the lens body, when a plurality of clamping lugs and a plurality of clamping slots are provided, the clamping lugs can be clamped in the clamping slots simultaneously and respectively by moving the lens body. In this way, the clamping lugs need not be clamped in the clamping slots respectively in sequence, thus saving time and labor. Moreover, the clamping lugs can be fixed by moving into the clamping slots, which takes less time than screwing bolts, thus further improving the mounting efficiency.

The present disclosure provides a method of manufacturing a lens module of an LED lamp. The method may include providing a chassis with a mounting slot; fixing a lens body in the mounting slot through a clamping lug and a clamping slot; and clamping the clamping lug in the clamping slot after moving the lens body along the mounting slot.

The method may also include providing a stopper part for the clamping lug with a protrusion that is clamped in the clamping slot; and providing a guide part for the clamping lug where the guide part is moved in the clamping slot to guide the protrusion, and the stopper part is provided separately from the guide part.

The method may further include obtaining an annular shape for the lens body where the mounting slot is recessed toward an inside of the chassis and has an annular shape that is adapted to the annular shape of the lens body, and the clamping slot is provided on a bottom wall of the chassis; and claiming the clamping lug in the clamping slot after rotating the lens body around the mounting slot.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above description involves only examples of the present disclosure and is not intended to limit the present disclosure. For those skilled in the art, the present disclosure may have various modifications and changes. Any modification, equivalent substitution, improvement, etc., made within the spirit and principle of the present disclosure shall be included within the scope of the claims of the present disclosure.

What is claimed is:

1. An LED lamp, comprising:

a lens module provided with a chassis and a lens body, and an LED light source provided on the lens body, wherein the chassis is provided with a mounting slot and the lens body is fixed in the mounting slot through a clamping lug and a clamping slot, and wherein, after moving the lens body along the mounting slot, the clamping lug is clamped in the clamping slot, wherein the clamping lug comprises:

a stopper part provided with a protrusion that is clamped in the clamping slot, and a guide part that is moved in the clamping slot to guide the protrusion, wherein the stopper part is provided separately from the guide part.

2. A lens module of an LED lamp, comprising:

a chassis provided with a mounting slot; and a lens body fixed in the mounting slot through a clamping lug and a clamping slot, wherein, after moving the lens body along the mounting slot, the clamping lug is clamped in the clamping slot; and an LED light source provided on the lens body, wherein the clamping lug comprises:

a stopper part provided with a protrusion that is clamped in the clamping slot, and a guide part that is moved in the clamping slot to guide the protrusion, wherein the stopper part is provided separately from the guide part.

3. The lens module according to claim 2, wherein the guide part and the stopper part are both located at a same side of the lens body, and are protruded out of the lens body toward the same side of the lens body.

4. The lens module according to claim 2, wherein the guide part comprises:

a guide part body that is connected with the lens body and is moved in the clamping slot, and a receiving hole that is provided at a front end of the guide part body and is provided to receive the stopper part.

5. The lens module according to claim 4, wherein the stopper part comprises a stopper part body, of which a front end is connected with a front wall of the receiving hole, wherein the protrusion is provided at a rear end of the stopper part body.

6. The lens module according to claim 5, wherein the guide part body and the stopper part body are both in plate-shaped structures.

7. The lens module according to claim 5, wherein the clamping slot comprises:

a first clamping slot part that is configured to place the guide part body and is recessed, and a second clamping slot part that is located in front of the first clamping slot part and is provided with the protrusion, and wherein the first clamping slot part is spaced from the second clamping slot part, and a front side wall of the first clamping slot part is provided with an insertion opening, into which the guide part body is inserted.

8. The lens module according to claim 2, wherein:

the lens body has an annular shape wherein the mounting slot is recessed toward an inside of the chassis and has an annular shape that is adapted to the annular shape of the lens body, and the clamping slot is provided on a bottom wall of the chassis; and after rotating the lens body around the mounting slot, the clamping lug is clamped in the clamping slot.

9. The lens module according to claim 8, wherein at least three clamping lugs and clamping slots that are matched with each of the at least three clamping lugs are provided along a circumferential direction of the lens body.

10. A method of manufacturing a lens module of an LED lamp, comprising:

providing a chassis with a mounting slot;

providing an LED light source on a lens body;

fixing the lens body in the mounting slot through a clamping lug and a clamping slot;

clamping the clamping lug in the clamping slot after moving the lens body along the mounting slot, providing a stopper part for the clamping lug with a protrusion that is clamped in the clamping slot; and providing a guide part for the clamping lug wherein the guide part is moved in the clamping slot to guide the protrusion, and the stopper part is provided separately from the guide part.

11. The method according to claim 10, further comprising:

obtaining an annular shape for the lens body wherein the mounting slot is recessed toward an inside of the chassis and has an annular shape that is adapted to the annular shape of the lens body, and the clamping slot is provided on a bottom wall of the chassis; and claiming the clamping lug in the clamping slot after rotating the lens body around the mounting slot.

* * * * *